United States Patent [19]

Sheu

[11] Patent Number: 4,981,275

[45] Date of Patent: Jan. 1, 1991

[54] PHOTOELECTRIC GARBAGE BIN

[76] Inventor: Miin-Shiou Sheu, No. 156, Cheng Kung Road, Changhua, Taiwan

[21] Appl. No.: 502,690

[22] Filed: Apr. 2, 1990

[51] Int. Cl.[5] ..... A47G 23/02

[52] U.S. Cl. ..... 248/147; 220/263; 49/25; 312/319; D34/8

[58] Field of Search ..... 49/25, 31, 347; 312/319, 223; 220/262, 263, 1 T; D34/8, 10, 11; 248/146, 147

[56] References Cited

U.S. PATENT DOCUMENTS

| | | | |
|---|---|---|---|
| 1,364,209 | 1/1921 | Richardson | D34/8 |
| 3,096,900 | 9/1963 | Breneman | D34/8 |
| 3,836,037 | 9/1974 | Bass | 248/147 |
| 3,891,115 | 6/1975 | Ono | 49/25 |

FOREIGN PATENT DOCUMENTS

| | | | |
|---|---|---|---|
| 0629293 | 4/1936 | Fed. Rep. of Germany | 248/147 |

*Primary Examiner*—Kenneth J. Dorner
*Assistant Examiner*—Gerald A. Anderson
*Attorney, Agent, or Firm*—Bacon & Thomas

[57] ABSTRACT

A photoelectric garbage bin, which includes a rectangular housing having an opening on its beveling upper portion covered by a pivotal cover board and defining therein a space for the setting therein of a dustbin. Through the detection of an electric eye on the housing, a motor is driven to carry a rope pulley to take up or let off a rope, which extends from the rope pulley through an idle wheel to secured to the back side of the cover board, so as to drive the cover board to open the opening of the housing or permit two torsion springs to automatically turn the cover board back to original position to completely close up the opening of the housing.

4 Claims, 3 Drawing Sheets

PHOTOELECTRIC GARBAGE BIN

BACKGROUND OF THE INVENTION

1. Field of Invention

The present invention relates to garbage bins and more particularly to a garbage bin which utilizes an electric eye to automatically control a driving motor to take up or let off a rope so as to carry a movable cover board to open or close the opening of the garbage bin.

2. Description of the Prior Art

The garbage bin is a container for garbage. If an open type garbage bin is used, it must be frequently cleaned or the garbage contained therein may produce odor smell or harmful gas to pollute the air. In order to protect against environmental pollution, it is better to use cover equipped garbage bin. If a separate cover is used to cover a garbage bin, the cover must be removed and closed frequently during the use of the garbage bin, and hand contamination may happen easily. There is another kind of garbage bin which has an opening on its front panel and covered with a movable cover board, in which the movable cover board can be pushed to rotate so as to open the opening of the garbage bin for throwing of garbage therein. However, this type of garbage bin still can not eliminate the problem of hand contamination. It is therefore, an idea of the present inventor to provide a garbage bin which can efficiently eliminate the said problems.

SUMMARY OF THE INVENTION

One object of the present invention is to provide a photoelectric garbage bin which includes an electric eye to automatically trigger a motor to drive a rope pulley to take up a rope to further carry a cover board to open the garbage bin upon approaching of the hand, and to let the rope pulley let off the rope permitting two torsion springs to drive the cover board to close up the garbage bin.

Another object of the present invention is to provide a photoelectric garbage bin which includes an idle wheel spaced away from a rope pulley and serving as a fulcrum to facilitate the motion of a rope in carrying or releasing a cover board to open or close the garbage bin.

Still another object of the present invention is to provide a photoelectric garbage bin which includes a pair of torsion springs to automatically turn a cover board to close up the garbage bin when pull force is released from such a cover board.

BRIEF DESCRIPTION OF THE DRAWINGS

The foregoing and other objects, features and advantages of the present invention will be best understood from the following description, the appended claims and the accompanying drawings in which:

DETAILED DESCRIPTION OF THE PREFERRED EMBODIMENTS

Figure 1:
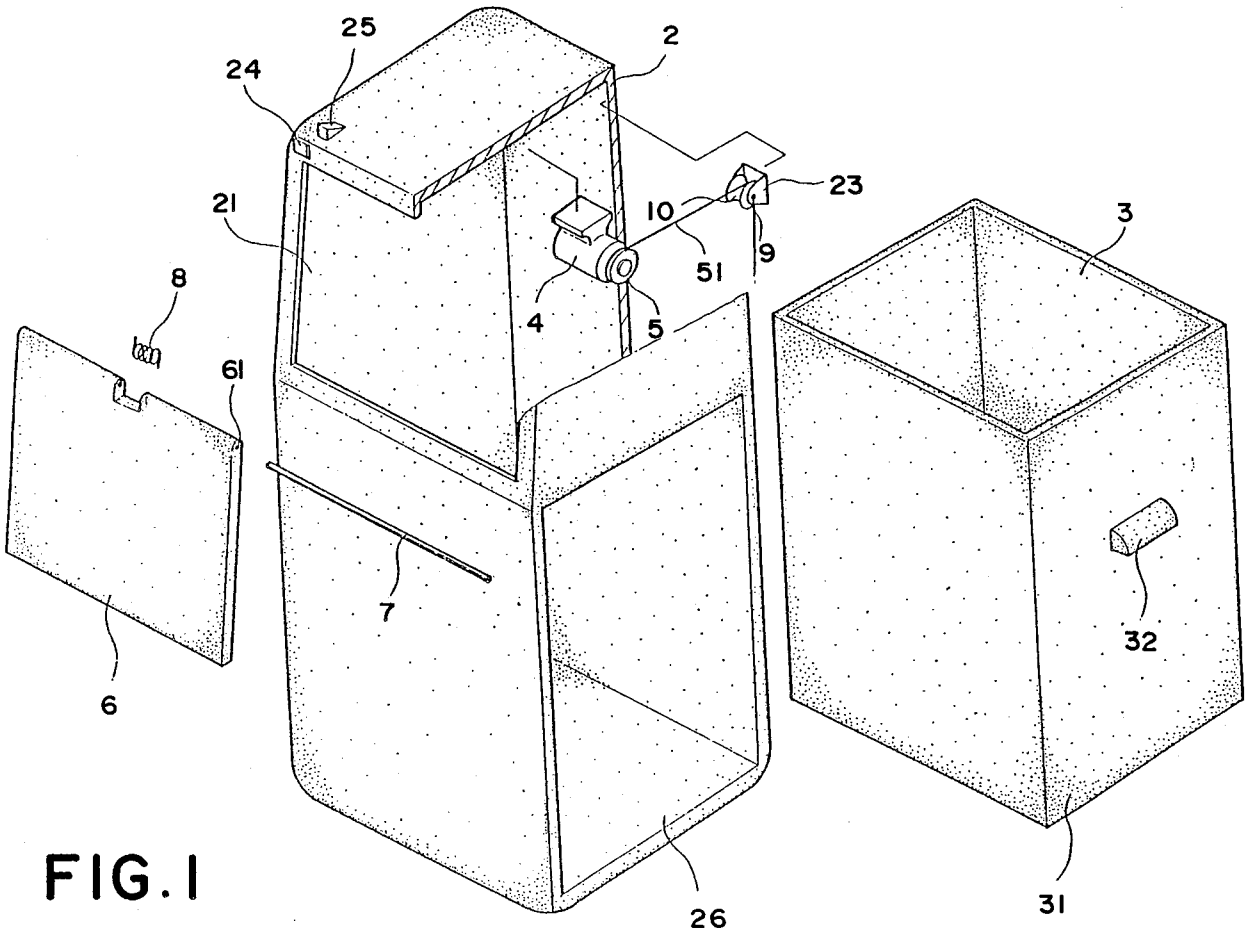
FIG. 1 is a perspective fragmentary view of the present invention.
Figure 2:
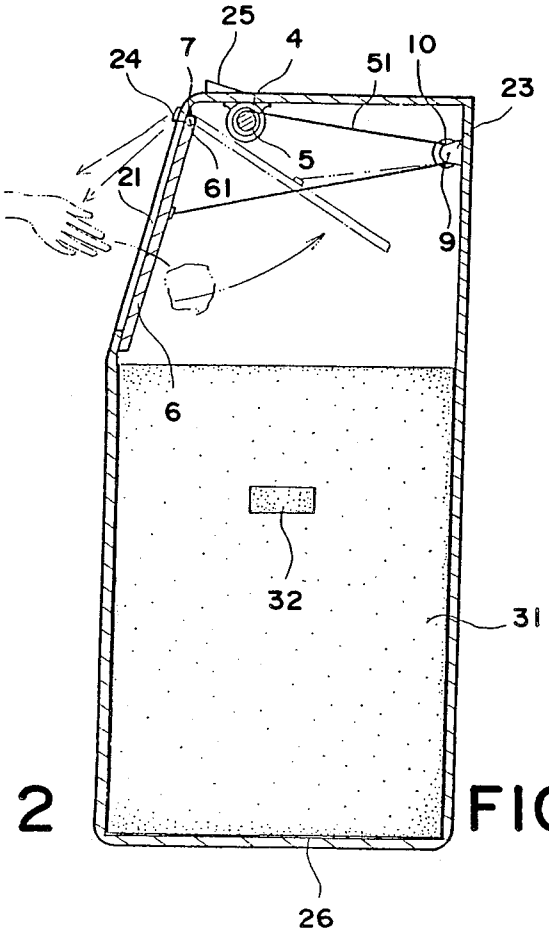
FIG. 2 is an assembly and partly sectional view thereof.

Referring to FIGS. 1 and 2, a photoelectric garbage bin of the present invention is generally comprised of a rectangular housing 2, a dustbin 3, a horizontal motor 4, a rope pulley 5, a movable cover board 6, a pivot pin 7, two torsion springs 8, a fastening pin 9, and an idle wheel 10.

The rectangular housing 2 includes a beveling upper portion having a rectangular opening 21, a holder plate 23 on the inner surface of its back wall at an upper location, an electric eye 24 externally on the top of its front wall at one corner, and a control switch 25 on its top wall, a slot 26 at one side. The dustbin 3 has a side panel 31 stopped at the side slot 26 of the rectangular housing 2, which side panel 31 has a hand-hold 32 for the holding of the hand. The horizontal motor 4 is mounted on the ceiling of the rectangular housing 2. The rope pulley 5 is mounted on the motor shaft of the horizontal motor 4. The rope 51 which is mounted on the rope pulley 5 has its one end winding around the idle wheel 10 and connected to the inner side of the movable cover board 6. The movable cover board 6 has a through-hole 61 through its upper end for the insertion therethrough of the pivot pin 7. After insertion through the movable cover board 6, the two torsion springs 8 are respectively sleeved on the pivot pin 7 at both ends, and the both ends 71 of the pivot pin 7 are respectively inserted in two holes 22 on the rectangular housing 2 to secure the movable cover board 6 to the rectangular housing 2 permitting the movable cover board 6 to pivotably cover the rectangular opening 21 (see FIG. 2).

Figure 3:
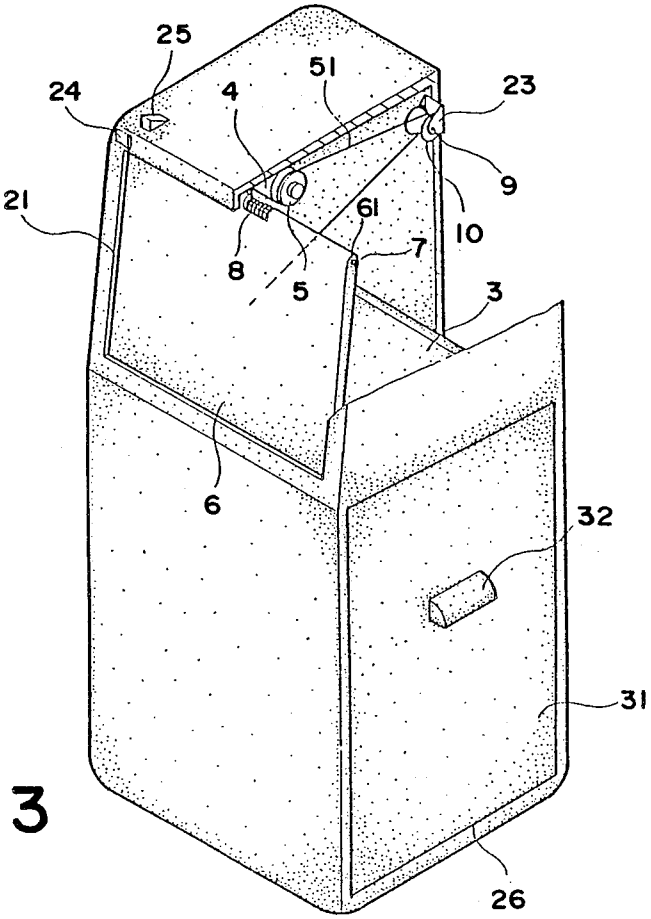
FIG. 3 is a longitudinal sectional view thereof, illustrating the motion of the movable cover board when the electric eye detects the approach of a hand.

Referring to FIG. 3, the dustbin 3 is pulled out of the rectangular housing 2 through its hand-hold 32. After a plastic garbage bag is set in the dustbin 3, the dustbin 3 is inserted in the rectangular housing 2 again. After setting of the dustbin 3 in the rectangular housing 2, the control switch 25 is shifted to ON to trigger the electric eye 24 to start operation. When a hand is approaching within the detective range of the electric eye 24, the motor 4 is immediately triggered by the electric eye 24 to drive the rope pulley 5 to take up the rope 51 through the idle wheel 10. Therefore, the movable cover board 6 is gradually pulled by the rope 51 to rotate on the pivot pin 7 through certain angle relative to the rectangular housing 2 so as to open the rectangular opening 21. After garbage is thrown to the dustbin 3 and the hand is moved out of the detective range of the electric eye 24, the rope pulley 5 is released to let off the rope 51 permitting the torsion springs 8 to automatically turn the movable cover board 6 to original position in covering over the rectangular opening 21 of the rectangular housing 2.

Figure 4:
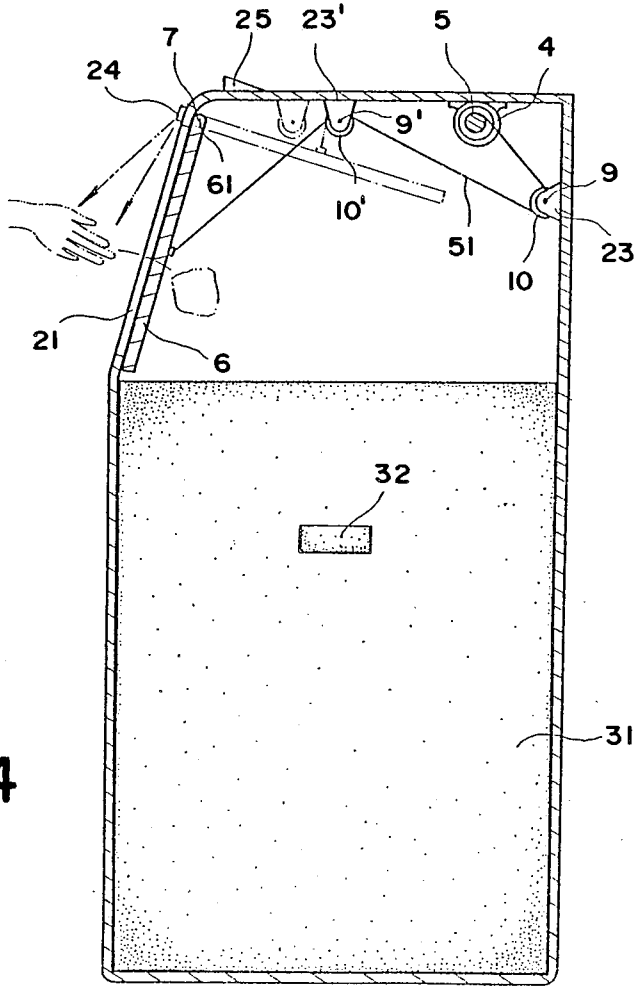
FIG. 4 is a longitudinal sectional view of an alternate form of the present invention.

Referring to FIG. 4, therein illustrated is an alternate form of the present invention, in which the holder plate 23, the fastening pin 9 and the idle wheel 10 are mounted on the inner wall surface of the back panel of the rectangular housing 2 at an upper location; the horizontal motor 4 and the rope pulley 5 are mounted on the ceiling of the rectangular housing 2 at the back; an additional holder plate 23', fastening pin 9' and idle wheel 10' are mounted on the ceiling of the rectangular housing 2 in front of the horizontal motor 4 and the rope pulley 5; the rope 51 has its one end secured to the rope pulley 5 and its other end turning around the idle wheel 10 through the additional idle wheel 10' to secure to the back side of the movable cover board 6. When the control switch 25 is turned on, the electric eye 24 starts detecting. If any object (hand) reaches within the detective range of the electric eye 24, the electric eye 24 immediately drives the motor 4 to carry the rope pulley 5 to take up the rope 51. Therefore, through the bearing points on the idle wheels 10 and 10', the movable cover board 6 is pulled to turn inward and upward to fully open the rectangular opening 21 so that garbage can be conveniently thrown to the dustbin 3. The position of the additional idle wheel 10' can be flexibly set according to the size of the rectangular housing 2 so that the movable cover board 6 can be efficiently controlled to open or close.

I claim:

1. A photoelectric garbage binds including: a rectangular housing comprising a top wall, a front wall, a back wall and two sidewalls; a beveling upper portion of the front wall having a rectangular opening defining a through-hole, a holder plate on the inner surface of the back wall at an upper location, an electric eye mounted externally on the top of the front wall at one corner, a control switch on the top wall to control the operation of said electric eye, and a slot in one of the sidewalls;

a dustbin having sides and a hand-hold on one side and said dustbin being set inside said housing through said slot;

a horizontal motor mounted on the ceiling of said rectangular housing;

a rope pulley mounted on a motor shaft of said motor and driven by said motor to take up or release a rope;

a movable cover board having a cover board through-hole for the insertion therein of a pivot pin to pivotally secure the cover board to the through-hole of said housing and the cover board controlled by said rope to close or open said rectangular opening;

at least one torsion spring mounted on said pivot pin to automotically push said movable cover board to close said rectangular opening;

an idle wheel mounted on the holder plate by a fastening pin, said holder plate being mounted on the inner surface of the back wall of said housing for the winding therethrough of said rope;

wherein said electric eye drives said motor to take up said rope through said rope pulley and said idle wheel so as to drive said movable cover board pivotally away from said rectangular opening when a moving object is detected by said electric eye; said torsion spring driving said movable cover board back to close said rectangular opening upon releasing of said rope when said moving object is out of the detection range of said electric eye.

2. A photoelectric garbage bin as claimed in claim 1, wherein said idle wheel serves as a fulcrum to facilitate the operation of said motor and said rope pulley in taking up or letting off said rope so as to efficiently control said movable cover board to open or close said rectangular opening.

3. A photoelectric garbage bin as claimed in claim 1, wherein said torsion springs automatically drive said movable cover board to rotate back so as to close up said rectangular opening when the pull force through said rope is released therefrom.

4. A photoelectric garbage bin as claimed in claim I, wherein an auxiliary idle wheel is mounted on another holder plate through another fastening pin and secured to the ceiling of said rectangular housing in front of said horizontal motor and said rope pulley; said idle wheel and said holder plate are mounted on the inner side of the back wall of said housing at an upper location; and said rope is extending from said rope pulley through said idle wheel and turning through said auxiliary idle wheel to secure to the back side of said movable cover board to efficiently pull or release said movable cover board to open or close said rectangular opening through the operation of said motor and said electric eye.

* * * * *